US006477834B1

(12) United States Patent
Asanuma et al.

(10) Patent No.: US 6,477,834 B1
(45) Date of Patent: Nov. 12, 2002

(54) EXHAUST EMISSION CONTROLLING APPARATUS OF INTERNAL COMBUSTION ENGINE

(75) Inventors: Takamitsu Asanuma, Susono; Kenji Katoh, Shizuoka-ken; Masato Goto, Susono, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/423,565

(22) PCT Filed: May 1, 1998

(86) PCT No.: PCT/JP98/02004

§ 371 (c)(1),
(2), (4) Date: Jan. 31, 2000

(87) PCT Pub. No.: WO98/51919

PCT Pub. Date: Nov. 19, 1998

(30) Foreign Application Priority Data

May 12, 1997 (JP) ..... 9-120700

(51) Int. Cl.[7] ..... F01N 3/00

(52) U.S. Cl. ..... 60/295; 60/285; 60/286; 60/297

(58) Field of Search ..... 60/285, 286, 295, 60/297, 301

(56) References Cited

U.S. PATENT DOCUMENTS 5,471,836 A * 12/1995 Takeshima et al. ..... 60/297
5,974,794 A * 11/1999 Gotoh et al. ..... 60/286
5,992,142 A * 11/1999 Pott ..... 60/274
6,014,859 A * 1/2000 Yoshizaki et al. ..... 60/285
6,125,629 A * 10/2000 Patchett ..... 60/286
6,195,987 B1 * 3/2001 Miyashita ..... 60/285

FOREIGN PATENT DOCUMENTS

| | | |
|---|---|---|
| JP | 6-129246 | 5/1994 |
| JP | 6-257487 | 9/1994 |
| JP | 6-272536 | 9/1994 |
| JP | 6-280550 | 10/1994 |
| JP | 9-291814 | 11/1997 |
| WO | WO93/07363 | 4/1993 |
| WO | WO93/25806 | 12/1993 |

OTHER PUBLICATIONS

Co–pending U.S. patent application Ser. No. 09/054,172, filed Apr. 2, 1998.

* cited by examiner

*Primary Examiner*—Thomas Denion
*Assistant Examiner*—Binh Tran
(74) *Attorney, Agent, or Firm*—Kenyon & Kenyon

(57) ABSTRACT

A NOx absorbent (18) is disposed in an exhaust passage (17) of an internal combustion engine (1), and a control circuit (30) is provided for controlling the amount of fuel injection into the engine (1). The control circuit 30 works to operate the engine at a rich air-fuel ratio by increasing the amount of fuel supply to the engine so that NOx absorbed by the NOx absorbent when the engine was last stopped is released in all amounts and is purified by reduction after the start of the engine until the engine is first operated at a lean air-fuel ratio. This prevents the release of unpurified NOx from the NOx absorbent (18) at the start of the engine. The operation at a lean air-fuel ratio is assumed in a state where almost no NOx has been absorbed by the NOx absorbent (18), enabling the absorbing capacity of the NOx absorbent to be utilized to the maximum degree.

13 Claims, 9 Drawing Sheets

EXHAUST EMISSION CONTROLLING APPARATUS OF INTERNAL COMBUSTION ENGINE

TECHNICAL FIELD

The present invention relates to an exhaust gas purification device for an internal combustion engine.

BACKGROUND ART

The present applicant has already proposed an exhaust gas purification device for an internal combustion engine, in which a NOx absorbent is disposed in an exhaust passage of an internal combustion engine to absorb NOx (nitrogen oxide) in the exhaust gas when the exhaust gas flowing therein has a lean air-fuel ratio and to release the absorbed NOx when the oxygen concentration in the exhaust gas flowing therein has decreased, so that NOx in the exhaust gas is absorbed by the NOx absorbent while the engine is operated at a lean air-fuel ratio (see International Unexamined Patent Publication WO93-25806). The exhaust gas purification device disclosed in this publication is equipped with an estimation means for estimating the amount of NOx absorbed by the NOx absorbent in order to monitor the NOx holding amount in the NOx absorbent at all times during operation. When the NOx holding amount reaches a predetermined value, the oxygen concentration in the exhaust gas flowing into the NOx absorbent is lowered to release the absorbed NOx from the NOx absorbent and to purify the released NOx by reduction with reducing components such as unburned HC and CO in the exhaust gas (in this specification, the operation for releasing the absorbed NOx from the NOx absorbent and for purifying the NOx by reduction is called "a regenerating operation of the NOx absorbent"). According to the exhaust gas purification device taught in the above-mentioned publication, the regenerating operation is executed every time the NOx holding amount of the NOx absorbent reaches a predetermined value, so that the NOx holding amount of the NOx absorbent will not increase excessively and that the NOx absorbent will not be saturated with NOx which it has absorbed.

When the regenerating operation of the NOx absorbent is executed every time when the NOx holding amount estimated during the operation of the engine has reached a predetermined value, however, there remains a probability in that unpurified NOx is released from the NOx absorbent at the start of the engine.

When the regenerating operation is executed every time when the NOx holding amount in the NOx absorbent has reached a predetermined value during the operation of the engine as done in the device taught in the above-mentioned publication, it may often happen that a considerable amount of NOx remains held by the NOx absorbent at the next start of the engine when, for example, the engine is stopped just before the NOx holding amount in the NOx absorbent has reached the predetermined value.

At a cold start of an engine, in general, it is accepted practice to effect the fuel increment for warming-up or the fuel increment for start-up by supplying fuel in an increased amount to the engine based on the engine temperature, so that the engine is operated at an air-fuel ratio (e.g., an air-fuel ratio of from about 12 to about 14) which is more than a normal air-fuel ratio for a predetermined period of time after the start. The fuel increment decreases with a rise in the engine temperature and is canceled after the engine has been warmed up. That is, immediately after the start, the engine is operated at a rich air-fuel ratio. As the engine is gradually warmed up, the air-fuel ratio approaches the stoichiometric air-fuel ratio. After being warmed up, the engine operates at a lean air-fuel ratio based on the operating conditions. Therefore, the NOx absorbent is exposed to the exhaust gas of a rich air-fuel ratio due to an increase in the fuel supply at the start of the engine.

In order for the NOx absorbent to exhibit its NOx absorbing and releasing action, the NOx absorbent must have been heated to a temperature in excess of an activating temperature (e.g., about 250° C.) based on the kind of the NOx absorbent. When the NOx absorbent is at a low temperature, such as right after the start of the engine, therefore, no NOx is released from the NOx absorbent even when it is exposed to the exhaust gas having a rich air-fuel ratio.

With the NOx is absorbed in relatively large amounts by the NOx absorbent at the start of the engine, however, the absorbed NOx is released rapidly when the NOx absorbent is heated at a temperature in excess of the activating temperature after the start of the engine. As described above, the fuel increment after the start of the engine decreases with a rise in the engine temperature. When the temperature of the NOx absorbent has reached the activating temperature, therefore, the engine temperature has been raised correspondingly, and air-fuel ratio in the exhaust gas is not sufficiently rich.

When the NOx is released rapidly from the NOx absorbent in this state, HC and CO necessary for reducing the NOx become in short supply on the NOx absorbent; i.e., the NOx that is released may often be released into the open air without being purified.

Since the engine operating condition is not stable until the engine is warmed up after starting, when the engine starts with NOx being absorbed in relatively large amounts by the NOx absorbent, NOx may often be released without being purified from the NOx absorbent due to a change in the operating conditions. Besides, the amount of the NOx that is released without being purified increases with an increase in the amount of NOx absorbed by the NOx absorbent. When the NOx absorbent having a large maximum NOx holding capacity (capable of occluding large amounts of NOX) is used, therefore, NOx is released in an increased amount without being purified.

Further, in the device for regenerating the NOx absorbent every time when the NOx holding amount in the NOx absorbent reaches a predetermined value while the engine is in operation as done by the device taught in the above-mentioned publication, the timing for executing the regenerating operation of the NOx absorbent may become incorrect if NOx remains absorbed by the NOx absorbent when the engine that has been warmed up is shifted to the lean air-fuel ratio operation, in addition to the above-mentioned problem. That is, in the device taught in the above-mentioned publication, the NOx holding amount in the NOx absorbent is monitored at all times, and the amount of NOx held by the NOx absorbent when the engine is halted is known. Therefore, if the NOx holding amount at the next stop of the engine is stored in a nonvolatile memory or the like means, it will be possible to estimate the correct amount of NOx held by the NOx absorbent from the start of the engine based on the stored amount and, hence, to execute the regenerating operation at a correct timing. In practice, however, NOx may often be released from the NOx absorbent while the engine is not in operation, and the NOx holding amount in the NOx absorbent at the start of the engine may often become different from the NOx holding amount of when the engine was halted in the previous time. Therefore, if the NOx holding amount after the start of the engine is estimated based on the NOx holding amount of when the engine was halted in the previous time, a difference occurs between the actual NOx holding amount and the estimated value, and the timing for thee regenerating operation becomes incorrect, deteriorating the quality of the exhaust gas.

DISCLOSURE OF THE INVENTION

In view of the above-mentioned problems, the object of the present invention is to provide an exhaust gas purification device for an internal combustion engine, which releases nearly all of NOx absorbed by the NOx absorbent during the operation of the engine in the previous time and reduces NOx by reduction, in order to prevent deviation in the timing for releasing the unpurified NOx after the start and in the timing for executing the regenerating operation.

According to the present invention, there is provided an exhaust gas purification device for an internal combustion engine, comprising:

- a NOx absorbent, disposed in an exhaust passage of the internal combustion engine, which absorbs NOx in the exhaust gas when the air-fuel ratio of the exhaust gas flowing in is lean, and releases the absorbed NOx and purifies it by reduction in a rich air-fuel ratio atmosphere; and
- a NOx-releasing means which, after the start of the engine, operates the engine at a predetermined rich air-fuel ratio determined by increasing the amount of fuel supplied to the engine, so that NOx absorbed by said NOx absorbent is released and is purified by reduction until the engine is first operated at a lean air-fuel ratio after the engine is started.

That is, according to the present invention, the regenerating operation of the NOx absorbent is executed at a predetermined rich air-fuel ratio after the start of the engine until the engine is first operated at a lean air-fuel ratio. The rich air-fuel ratio is the one which is different from an ordinary air-fuel ratio at the start of the engine, and with which the whole amount of NOx that is released can be purified by reduction even when the NOx is released in relatively large, amounts from the NOx absorbent. Therefore, nearly the whole amount of the NOx absorbed by the absorbent is released from the NOx absorbent and is purified by reduction before the engine is operated at a lean air-fuel ratio, making it possible to prevent unpurified NOx from being released at the start of the engine. Irrespective of the absorbed amount of NOx of when the engine was last stopped, further, almost no NOx has been absorbed by the NOx absorbent at the time when the engine assumes the lean air-fuel ratio operation. This makes it possible to correctly estimate the amount of NOx absorbed by the NOx absorbent during the operation and, hence, to correctly operate the timing for the regenerating operation.

As described above, the amount of NOx absorbed and held by the NOx absorbent is decreased (or, preferably, decreased to almost zero) after the start of the engine until the engine assumes the lean air-fuel ratio operation. At the time when the engine first assumes the lean air-fuel ratio operation after the engine is started, therefore, the NOx holding capacity of the NOx absorbent can be increased nearly up to its maximum limit. When use is made of the NOx absorbent having a maximum NOx holding capacity (maximum amount of NOx that can be occluded) to absorb and hold, as much as possible, the whole amount of NOx produced during the operation of the engine, therefore, the regenerating operation is no longer required during the ordinary lean air-fuel ratio operation of the engine. The regenerating operation may be executed only after the start of the engine.

BEST MODE FOR CARRYING OUT THE INVENTION

An embodiment of the present invention will now be described with reference to the accompanying drawings.

(1) First Embodiment

Figure 1:
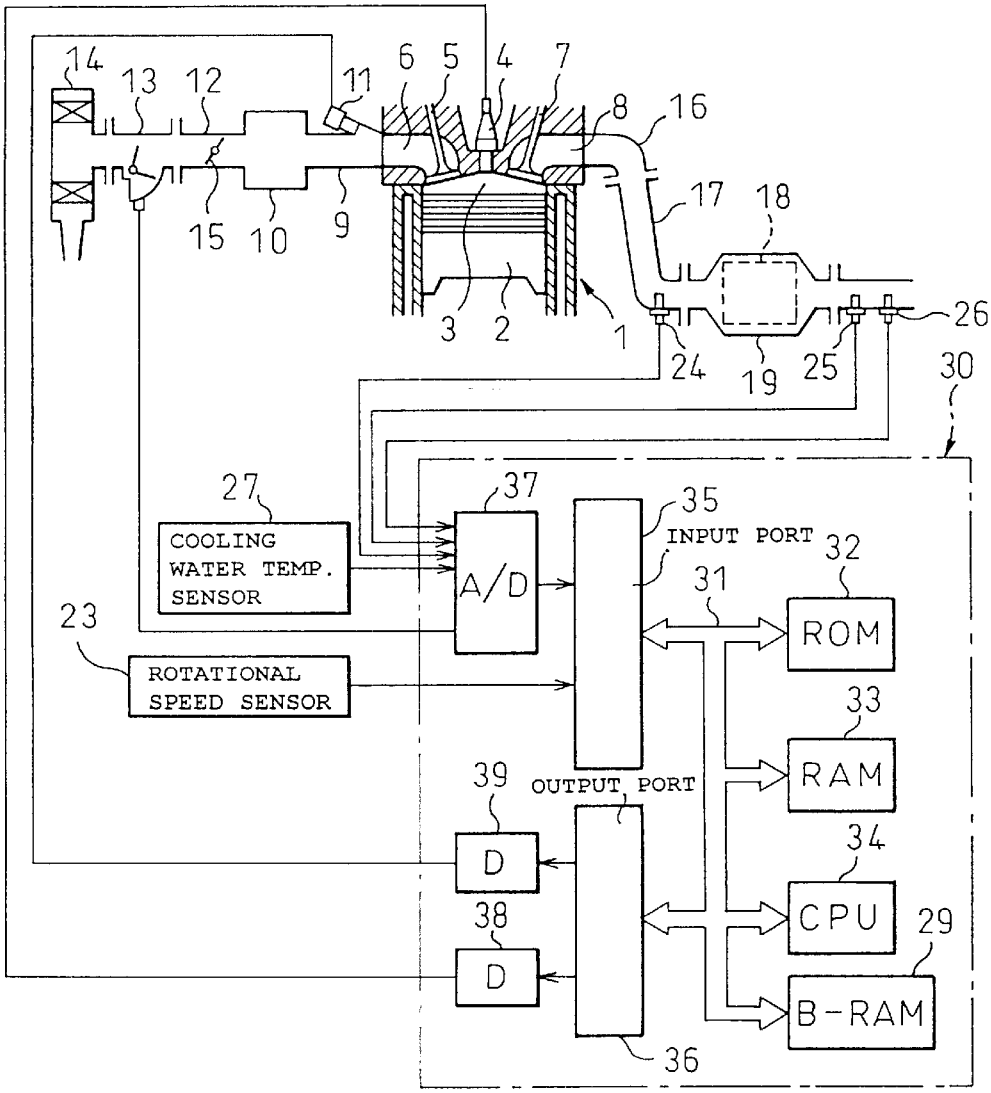
FIG. 1 is a diagram schematically illustrating the constitution of an embodiment of when the present invention is applied to an internal combustion engine for automobiles.

FIG. 1 is a diagram schematically illustrating the constitution of an embodiment in which the exhaust gas purification device of the invention is applied to an internal combustion engine for automobiles.

In FIG. 1, reference numeral 1 denotes an engine body, 2 denotes a piston, 3 denotes a combustion chamber, 4 denotes a spark plug, 5 denotes an intake valve, 6 denotes an intake port, 7 denotes an exhaust valve, and 8 denotes an exhaust port. The intake port 6 is coupled to a surge tank 10 through a corresponding branch pipe 9. Each branch pipe 9 is provided with a fuel injection valve 11 for injecting fuel into each intake port 6. The surge tank 10 is coupled to an air cleaner, through an intake duct 12 and an air flow meter 13, and a throttle valve 15 is disposed in the intake duct 12. The exhaust port 8 is connected to a casing 19 containing a NOx absorbent 18 through an exhaust manifold 16 and an exhaust pipe 17. An upstream-side exhaust gas component sensor 24 is provided in the exhaust pipe 17 on the upstream side of the NOx absorbent 18 to detect the concentration of a particular component in the exhaust gas. A downstream-side exhaust gas component sensor 25 for detecting the concentration of a particular component in the exhaust gas and an exhaust gas temperature sensor 26 for detecting the temperature of the exhaust gas, are provided in the discharge pipe 17 on the downstream side of the NOx absorbent 18. As the exhaust gas component sensors 24 and 25, there can be used an oxygen concentration sensor for detecting the oxygen concentration in the exhaust gas, an HC sensor for detecting HC and CO concentrations in the exhaust gas, and a NOx sensor for detecting the concentration of NOx in the exhaust gas.

A control circuit 30 comprises a digital computer which includes a ROM (read-only memory) 32, a RAM (random access memory) 33, a CPU (microprocessor) 34, an input port 35, an output port 36, and a back-up RAM 29 that are connected to each other through a bidirectional bus 31. The back-up RAM 29 is a memory capable of holding its contents even when the main switch of the engine directly connected to a battery (not shown) is turned off. The air flow meter 13 produces an output voltage proportional to an intake air amount, which is input to the input port 35 through an AD converter 37 with a multiplexer. To the input port 35 is further connected a rotational speed sensor 23 which generates output pulses representing the rotational speed of the engine. To the input port 35 are further connected outputs from the exhaust gas temperature sensor 26, from the upstream-side and downstream-side exhaust gas component sensors 24 and 25, and a signal representing the temperature of the engine cooling water from the cooling water temperature sensor 27 provided in the engine cylinder jacket, all through the AD converter 37. The output port 36 is connected to the spark plug 4 and to the fuel injection valve 11 through an ignition circuit 38 and a drive circuit 39, respectively.

In the internal combustion engine shown in FIG. 1, the fuel injection time TAU is calculated based on, for example, the following formula after the engine has been warmed up, $$TAU=TP\times Kt$$

where TP is a basic fuel injection time, and Kt is a correction factor.

The basic fuel injection time TP is a fuel injection time necessary for setting the air-fuel ratio of the mixture supplied into the engine cylinders to be the stoichiometric air-fuel ratio. The basic fuel injection time TP has been determined in advance through experiment, and has been stored in the ROM 32 in the form of a map shown in FIG. 2 using the engine load Q/N (intake air amount Q/rotatiohal speed N of the engine) and the engine rotational speed N as parameters. The correction coefficient Kt is one for controlling the air-fuel ratio of the mixture supplied into the engine cylinders. When Kt=1, the mixture supplied into the engine cylinders acquires the stoichiometric air-fuel ratio. When Kt<1.0, on the other hand, the air-fuel ratio of the mixture supplied into the engine cylinder becomes larger than the stoichiometric air-fuel ratio, i.e., becomes lean. When Kt>1.0, the air-fuel ratio of the mixture supplied into the engine cylinders becomes smaller than the stoichiometric air-fuel ratio, i.e., becomes rich.

In the internal combustion engine shown in FIG. 1, the correction factor is usually maintained at, for example, Kt=0.7, and the mixture supplied into the engine cylinders has a lean air-fuel ratio to burn a lean mixture in the cylinders.

Figure 3:
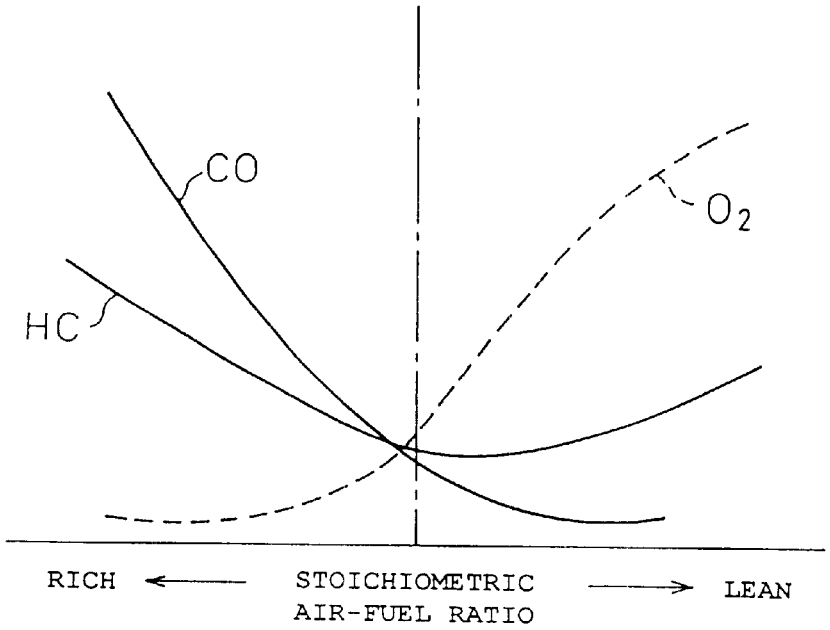
FIG. 3 is a diagram illustrating a change in the properties of the exhaust gas based on the air-fuel ratio.

FIG. 3 schematically illustrates the concentrations of representative components in the exhaust gas emitted from the combustion chamber 3. As will be understood from FIG. 3, the concentrations of unburned HC and CO in the exhaust gas emitted from the combustion chamber 3 increase as the air-fuel ratio of the mixture supplied into the combustion chamber 3 becomes rich, and the concentration of oxygen $O_2$ in the exhaust,, gas emitted from the combustion chamber 3 increases as the air-fuel ratio of the mixture supplied into the combustion chamber 3 becomes lean.

The NOx absorbent 18 contained in the casing 19 uses, for example, alumina as a carrier. On the carrier are carried at least one element selected from alkali metals such as potassium K, sodium Na, lithium Li and cesium Cs, or rare earth elements such as lanthanum La and yttrium Y, as well as a noble metal such as platinum Pt or rhodium Rh. If the ratio of air to fuel supplied to the engine intake passage and to the exhaust passage on the upstream side of the NOx absorbent 18, is referred to as the air-fuel ratio of the exhaust gas flowing into the NOx absorbent 18, the NOx absorbent 18, when heated higher than its activating temperature, exhibits the NOx absorbing and releasing action to absorb NOx when the exhaust gas flowing in has a lean air-fuel ratio and to release the absorbed NOx when the oxygen concentration decreases in the exhaust gas flowing in. When neither fuel nor air is supplied to the exhaust passage on the upstream side of the NOx absorbent 18, the air-fuel ratio of the exhaust gas flowing in is in agreement with the air-fuel ratio of the mixture supplied to the combustion chamber 3. In this case, therefore, the NOx absorbent 18 absorbs the NOx when the mixture supplied into the combustion chamber 3 has a lean air-fuel ratio, and releases the absorbed NOx when the oxygen concentration decreases in the mixture supplied into the combustion chamber 3.

The above-mentioned NOx absorbent 18 that is disposed in the engine exhaust passage executes the NOx absorbing and releasing action. Though the mechanism of the absorbing and releasing action has not been clarified in detail yet, it is considered that this action is based on a mechanism schematically illustrated in FIG. 4. This mechanism will now be described with reference to the case where platinum Pt and barium Ba are carried on the carrier. The same mechanism, however, is established even when other noble metals, alkali metals, alkaline earths or rare earths are carried.

Figure 4A:
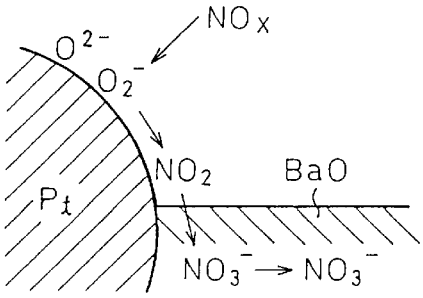
FIGS. 4A and 4B are diagrams illustrating the action of the NOx absorbent for releasing NOX.

That is, as the exhaust gas flowing in becomes considerably lean, the oxygen concentration greatly increases in the exhaust gas that flows in, whereby oxygen $O_2$ adheres in the form of $O_2^-$or $O^{2-}$on the surface of platinum Pt as shown in FIG. 4(A). NO in the exhaust gas flowing in reacts with $O_2^-$or $O^{2-}$on the surface of platinum Pt to form $NO_2$ ($2NO+O_2\rightarrow 2NO_2$). Then, part of $NO_2$ that is formed is oxidized on platinum Pt, absorbed by the absorbent, bonds to barium oxide BaO, and diffuses in the absorbent in the form of nitric acid ions $NO_3^-$ as shown in FIG. 4(A). Thus, NOx is absorbed by the NOx absorbent 18.

So far as the oxygen concentrations is high in the exhaust gas flowing in, $NO_2$ is formed on the surface of platinum Pt. So far as the NOx absorbing capacity of the absorbent is not saturated, $NO_2$ is absorbed by the absorbent to form nitric acid ions $NO_3^-$. On the other hand, when the oxygen concentration decreases in the exhaust gas flowing in and $NO_2$ is formed in a decreased amount, the reaction proceeds in the reverse direction ($NO_3^-\rightarrow NO_2$), and nitric acid ions $NO_3^-$ in the absorbent are released therefrom in the form of $NO_2$. That is, when the oxygen concentration decreases in the exhaust gas flowing in, NOx is released from the NOx absorbent 18. As the degree of leanness decreases in the exhaust gas flowing in as shown in FIG. 3, the oxygen concentration decreases in the exhaust gas flowing in. Upon decreasing the degree of leanness in the exhaust gas flowing in, therefore, the NOx can be released from the NOx absorbent 18 even when the exhaust gas flowing in has a lean air-fuel ratio.

Figure 4B:
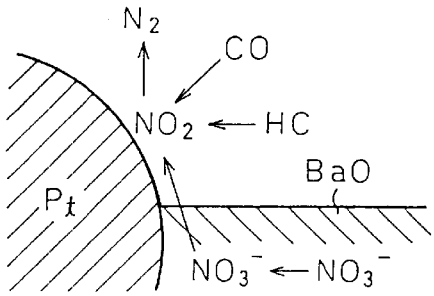
Figure 5:
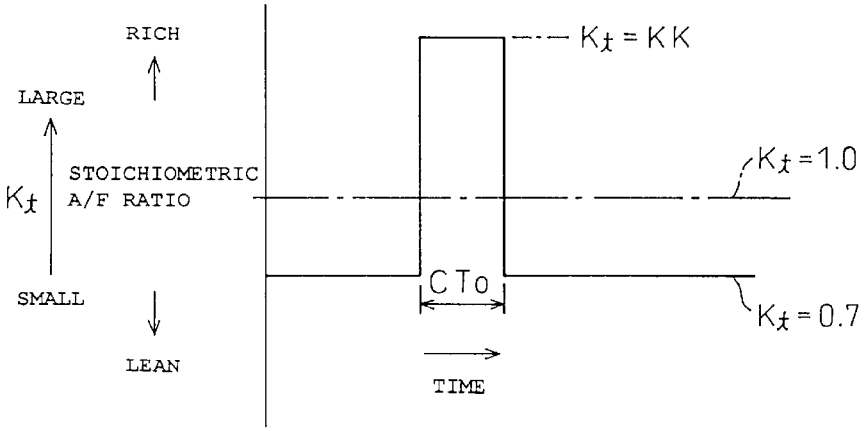
FIG. 5 is a diagram illustrating how to set the air-fuel ratio at the time of executing the regenerating operation of the NOx absorbent.

At this moment, if the air-fuel ratio of the exhaust gas flowing in is rendered to be rich, unburned HC and CO are emitted in large amounts from the engine as shown in FIG. 3. These unburned HC and CO react with oxygen $O_2^-$ or $O^{2-}$ on platinum Pt and are oxidized. Further, if the air-fuel ratio of the exhaust gas flowing is rendered to be rich, the oxygen concentration decreases to a considerable degree in the exhaust gas flowing in, whereby $NO_2$ is released from the absorbent and is reduced upon reacting with unburned HC and CO as shown in FIG. 4(B). Thus, as $NO_2$ no longer exists on the surface of platinum Pt, $NO_2$ is successively released from the absorbent. Upon rendering the air-fuel ratio of the exhaust gas flowing in to be rich, therefore, NOx is released from the NOx absorbent 18 within short periods of time.

That is, when the air-fuel ratio of the exhaust gas flowing in is rendered to be rich, first, the unburned HC and CO readily react with $O_2^-$ or $O^{2-}$ on platinum Pt and are oxidized. If the unburned HO and CO still remain even after $O_2^-$ or $O^{2-}$ on platinum Pt is consumed, then, NOx released from the absorbent and NOx emitted from the engine are reduced with unburned HC and CO.

In the internal combustion engine shown in FIG. 1 as described above, the mixture supplied into the engine cylinders is usually maintained lean (e.g., Kt=0.7), and NOx generated is absorbed by the NOx absorbent 18. As the NOx absorbent 18 continues to absorb NOx, however, the amount of NOx absorbed by the NOx absorbent 18 increases, and the NOx absorbing capacity gradually decreases. As the NOx absorbent 18 absorbs the NOx up to its maximum NOx holding capacity (saturation amount), further, the NOx absorbent 18 becomes no longer capable of absorbing NOx in the exhaust gas, and NOx emitted by the engine is directly released to the open air.

In this embodiment, therefore, the amount of NOx absorbed by the NOx absorbent 18 is estimated. When the absorbed amount of NOx that is estimated reaches a predetermined amount (e.g., from about 70 to about 80% of the saturation amount of the NOx absorbent 18), the mixture supplied into the engine cylinders is rendered to be rich (Kt=KK>1.0) for only a predetermined period of time $CT_0$, so that NOx that is absorbed is released from the NOx absorbent 18 and is purified by reduction with HC and CO components in the exhaust gas. In this embodiment, in other words, the regenerating operation of the NOx absorbent 18 is executed every time when the amount of NOx absorbed by the NOx absorbent 18 has reached a predetermined value.

Next, described below is a method of estimating the amount of NOx absorbed by the NOx absorbent 18 according to this embodiment.

The amount of NOx emitted from the engine varies based on the engine load conditions (e.g., intake air amount Q/N per a revolution of the engine and the rotational speed N of the engine). On the other hand, the amount of NOx absorbed by the NOx absorbent increases based on the amount of NOx emitted from the engine. By integrating the amounts of NOx emitted from the engine, therefore, the amount of NOx absorbed by the NOx absorbent can be correctly estimated. In this embodiment, therefore, the amount of NOx generated by the engine per a unit time is multiplied by a predetermined factor, and is integrated at a regular interval during the operation of the engine, and the amount of NOx absorbed by the NOx absorbent is judged by using the integrated value (NOx counter CR).

Figure 6:
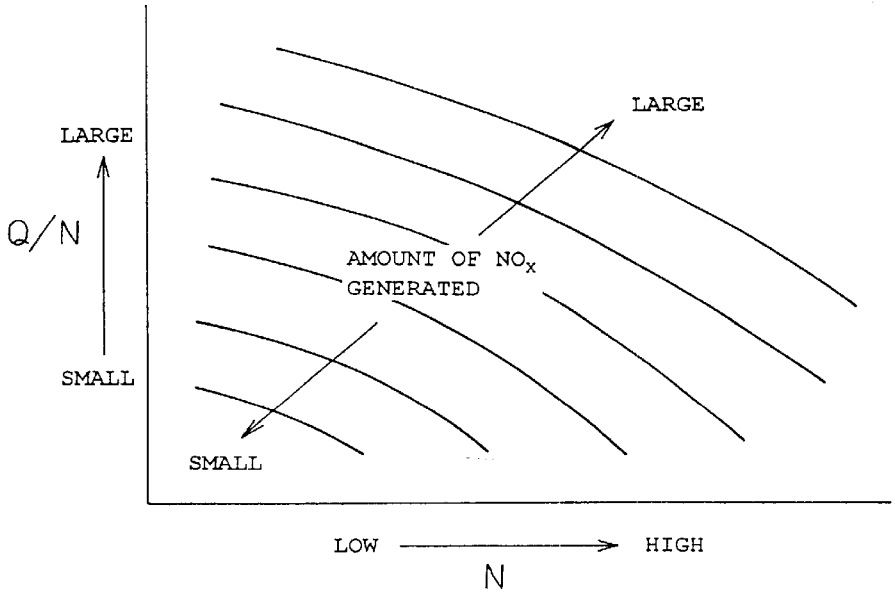
FIG. 6 is a diagram illustrating a change in the amount of NOx generated by the engine per a unit time based on the engine load conditions.

FIG. 6 is a diagram illustrating a change in the amount of NOx generated by the engine per a unit time based on the engine load conditions. In FIG. 6, the ordinate represents the intake air amount Q/N per a revolution of the engine 1, and the abscissa represents the rotational speed of the engine. As shown in FIG. 6, the amount of NOx generated by the engine per a unit time increases with an increase in the rotational speed N of the engine when Q/N remains the same, or increases with an increase in Q/N when the rotational speed N remains the same. In this embodiment, the amounts of NOx generated per a unit time shown in FIG. 6 have been stored in advance in the ROM 32 in the control circuit 30 in the form of a table of numerical values similar to that of FIG. 2 by using Q/N and N, and the values Q/N and N are read out at a regular interval, aid the generated amount of NOx is read out from the numerical value table by using the values Q/N and N and is used for estimating the amount of NOx absorbed by the NOX absorbent 18.

Figure 7:
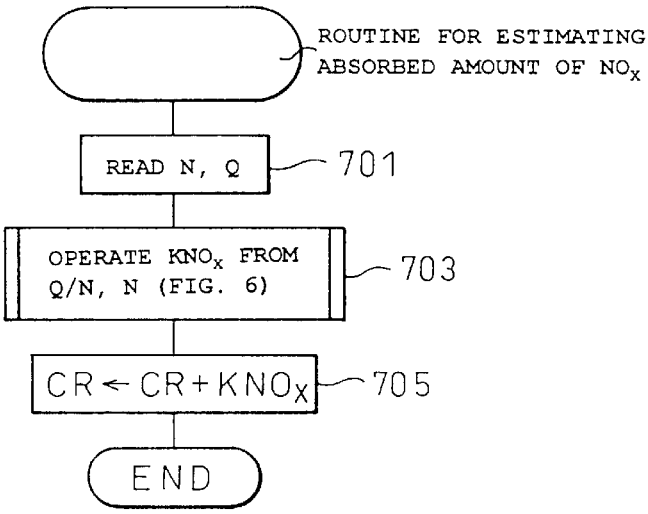
FIG. 7 is a flow chart illustrating the operation for estimating the amount of NOx absorbed by the NOx absorbent.

FIG. 7 is a flow chart illustrating the operation for estimating the amount of NOx absorbed by the NOx absorbent 18 according to the embodiment. This routine is executed by the control circuit 30 at predetermined intervals.

As the routine starts in FIG. 7, the engine rotational speed N and the intake air amount Q are read from the sensors 23 and 13 at step 701. At step 703, the intake air amount Q/N per a revolution of the engine is calculated from the values N and Q that ares read. Then, by using the values Q/N and N, the amount of NOx (KNOx) generated per a unit time is calculated using the numerical value table representing the amount of NOx generated by the engine per a unit time (FIG. 6) stored in the ROM 32. At step 705, the value KNOx is integrated to find a value of a NOx holding amount counter CR, and the routine ends.

In this embodiment, the value of the NOx holding amount counter CR is calculated based on the amount of NOx generated by the engine per a unit time. Here, however, it is considered that the amount of NOx absorbed by the NOx absorbent 18 increases in proportion to the time in which the engine is operated at a lean air-fuel ratio. It is therefore also possible to easily set the value of the counter CR by counting up the value of the counter CR by a predetermined amount at a predetermined interval while the engine is in operation at a lean air-fuel ratio.

Figure 8:
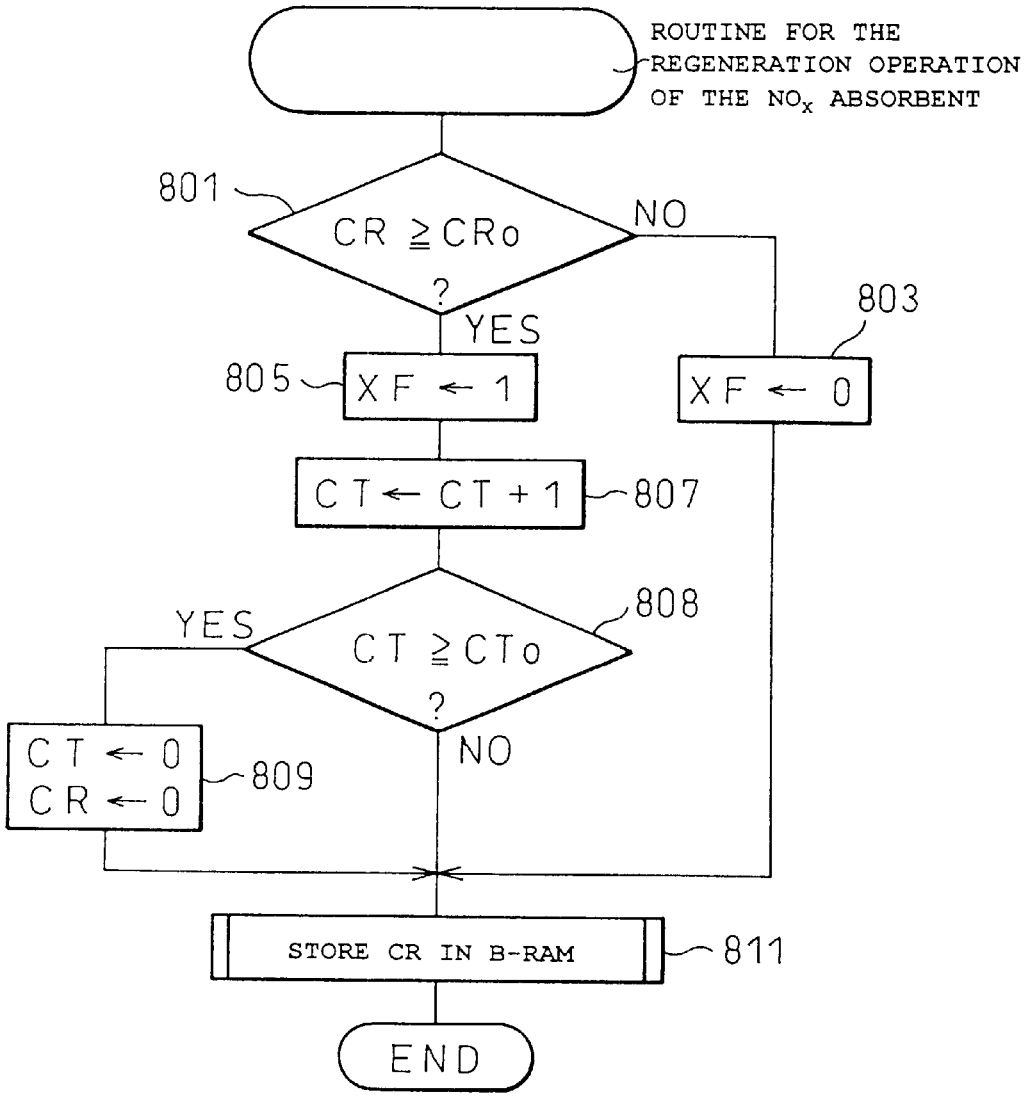
FIG. 8 is a flow chart illustrating an embodiment of the regenerating operation of the NOx absorbent.

FIG. 8 is a flow chart illustrating the regeneration operation of the NOx absorbent according to the embodiment. This routine is executed by the control circuit 30 of FIG. 1 at predetermined intervals.

As the routine starts in FIG. 8, it is judged at step 801 whether the regenerating operation of the NOx absorbent 18 be executed, i.e., whether the value of the NOx holding amount counter CR is greater than a predetermined value $CR_0$. In this embodiment, the value $CR_0$ is set to be from about 70 to about 80% of a maximum value KMAX which is the NOx saturation amount of the NOx absorbent, as will be described below.

When $CR<CR_0$ at step 801, NOx has been absorbed in small amounts by the NOx absorbent 18, and there is no need of executing the regenerating operation. At step 803, therefore, the value of the regenerating operation flag XF is set to 0 and the routine proceeds to step 811 where the present value of the NOx holding amount counter CR is stored in the back-up RAM 29 to end the routine. Thus, the latest absorbed amount of NOx is stored in the back-up RAM 29. When the value of the flag XF is set to 0, in the routine for calculating the amount of fuel injection which is separately executed, the correction factor Kt is set to 0.7, and the engine operates at a lean air-fuel ratio. Therefore, the NOx absorbent 18 continues to absorb NOx. When $CR \geqq CR_0$ at step 801, on the other hand, NOx has been absorbed in an increased amount by the NOx absorbent 18 and the regenerating operation must be executed. Therefore, the routine proceeds to step 805 where the regenerating operation flag XF is set to a value 1. When the value of the flag XF is set to 1, in the routine separately executed for operating the amount of fuel injection the correction factor Kt is set to KK. The value KK is larger than 1.0. In this embodiment, the value KK is set to a value of about 1.04. When the correction factor Kt is set to KK at step 805, therefore, the engine is operated at a rich air-fuel ratio, and the exhaust gas having a rich air-fuel ratio flows into the NOx absorbent 18. Therefore, the absorbed NOx is released from the NOx absorbent 18 and is purified by reduction with HC and CO components in the exhaust gas.

Steps 807 to 809 represent operations for ending the regenerating operation. In this embodiment, the regenerating operation of the NOx absorbent 18 ends after the passage of a predetermined period of time. That is, at step 807, a counter CT counts up. When the value of the counter CT reaches a predetermined value $CT_0$, i.e., when the regenerating operation is executed for a predetermined period of time ($CT \geqq CT_0$ at step 808), the values of the counters CR and CT are cleared. When the routine is executed next time, therefore, step 803 is executed after step 801, and the value of the regenerating operation flag XF is set to 0. In the routine separately executed for calculating the amount of fuel injection, therefore, the correction factor Kt is set to 0.7 again and the engine operates at a lean air-fuel ratio. After steps 808 and 809 have been executed, the present value CR of the NOx holding amount counter is stored in the back-up RAM 29 at step 811 to end the routine.

The counter value $CT_0$ is a regenerating time long enough for releasing the whole amount of NOx from the NOx absorbent when NOx has been held in an amount corresponding to the value $CR_0$ of the NOx holding amount counter. The value $CT_0$ varies based on the kind and capacity of the NOx absorbent and is, preferably, determined based on a practical experiment using the NOx absorbent.

When the engine is in operation as described above, the regenerating operation is executed every time when the amount of NOx absorbed by the NOx absorbent 18 increases to a predetermined value. Therefore, unpurified NOx is not released from the NOx absorbent 18. When the regenerating operation of the NOx absorbent 18 is executed every time when the absorbed amount of NOx has reached the predetermined value $CR_0$ (e.g., about 70 to 80% of a maximum value KMAX of the NOx saturation amount) during the operation of the engine, however, NOx remains absorbed by the NOx absorbent in an amount corresponding to $CR_0$ at the greatest if the engine is stopped just before the absorbed amount reaches $CR_0$.

In the engine of this embodiment, the fuel injection is not controlled using the above-mentioned correction factor Kt but, instead, the fuel injection TAU is determined by the following formula from the start of the engine until the engine is warmed up, i.e., $$TAU = TP \times FWL \times FASE$$

where TP is the above-mentioned basic fuel injection time, FWL is a fuel increment correction factor for warming-up, and FASE is a fuel increment correction factor after engine start.

The fuel increment correction factor FWL for warming-up is a factor for increasing the amount of fuel for preventing the combustion from losing stability that results from a poor atomization of fuel when the temperature of the engine is low, and assumes a value $FWL \geqq 1.0$. The factor FWL is determined based on the temperature of the engine (cooling water temperature) and is set to be a smaller value with an increase in the temperature of the engine, and is set to 1.0 after the engine has been warmed up (e.g., after thee cooling water temperature has reached about 80° C.).

The fuel increment correction factor after engine start FASE is a fuel increment for wetting the wall surface of the intake port with fuel at the start of the engine, and assumes a value $FASE \geqq 1.0$. That is, at the start of the engine, the intake port of the cylinder is dry. Therefore, an increased proportion of fuel that is injected adheres to the wall surface, and a decreased amount of fuel actually reaches the combustion chamber in the cylinder. The fuel increment correction factor after engine start FASE is a factor for increasing the amount of fuel by an amount that adheres on the wall surface, letting a required amount of fuel reach the cylinder. After the wall surface is sufficiently wet (after fuel has adhered on the wall surface in an amount corresponding to the operation conditions), the fuel increment correction factor FASE is set to 1.0. The correction factor FASE is set to a value (initial value) corresponding to the temperature of the cooling water at the start of the engine, and is then decreased after every predetermined number of times of fuel injection until 1.0 is reached.

Figure 9:
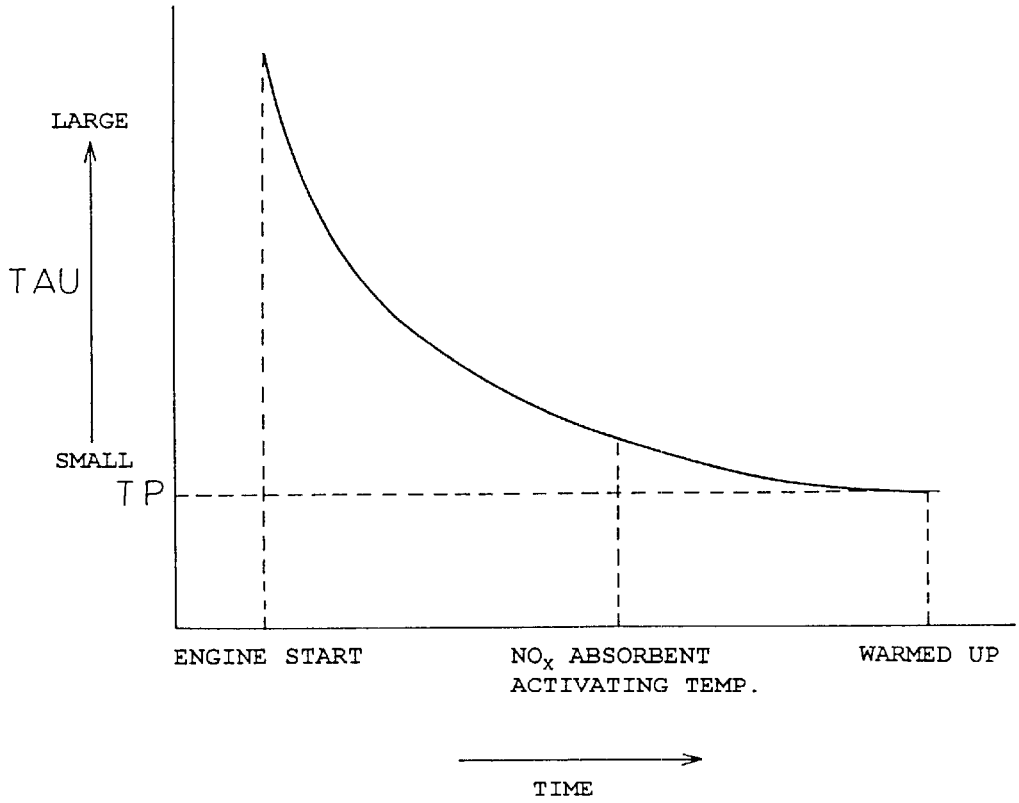
FIG. 9 is a diagram illustrating a change in the fuel increment during warming-up after the cold start of the engine.

FIG. 9 is a diagram illustrating a change in the fuel injection amount TAU after the cold start of the engine with the passage of time. Immediately after the cold start of the engine as shown in FIG. 9, the factors FWL and FASE have been set to values larger than 1.0. Therefore, the fuel injection amount TAU assumes a value larger than TP, and the engine air-fuel ratio becomes rich (e.g., an air-fuel ratio of about 1.2). Here, however, the fuel increment correction factor after engine start FASE decreases with the passage of time after the start, and the fuel increment correction factor for warming up FWL decreases with a rise in the cooling water temperature. Therefore, the fuel injection amount gradually decreases and converges to the basic fuel injection amount TP after the engine has been warmed up. Accompanying thereto, therefore, the engine air-fuel ratio rises from a rich air-fuel ratio of about 1.2 up to the stoichiometric air-fuel ratio.

At the start of the engine as described above, the engine air-fuel ratio gradually changes from a rich air-fuel ratio to the stoichiometric air-fuel ratio. Therefore, the air-fuel ratio of the exhaust gas passing through the NOx absorbent 18 gradually changes from the rich air-fuel ratio to the stoichiometric air-fuel ratio. In this embodiment as described above, however, NOx may have often been held by the NOx absorbent 18 in an amount corresponding to the counter value CR0 at the greatest at the start of the engine. When the engine is started in a state where NOx is held by the NOx absorbent 18 as described above, NOx is released rapidly, from the NOx absorbent at a moment when the temperature of the NOx absorbent is raised to arrive at its activating temperature. In this case, NOx that is released is all reduced on the Nox absorbent provided the engine air-fuel ratio is considerably rich (e.g., air-fuel ratio of about 12) at the time when NOx is released from the NOx absorbent. However, when the engine air-fuel ratio has been increased up to near the stoichiometric air-fuel ratio at a moment when NOx is released, i.e., at a moment when the NOx absorbent is heated to its activation temperature, the HC and CO components are in short supply in the exhaust gas, and NOx that is released is not all reduced.

Depending on the timing at which the NOx absorbent 18 is heated up to its activating temperature, therefore, the unpurified NOx is released into the open air.

Besides, the time required for regenerating the NOx absorbent is shortened as the air-fuel ratio becomes rich. Therefore, if the NOx absorbent 18 is heated up to its activating temperature after the engine air-fuel ratio has approached near the stoichiometric air-fuel ratio, NOx is not all released from the NOx absorbent 18 before the engine is warmed up; i.e., the engine is often shifted to the operation at a lean air-fuel ratio in a state where the absorbed NOx still remains in the NOx absorbent. In this case, it becomes difficult to estimate the amount of NOx remaining in the NOx absorbent 18, and the value of the NOx holding amount counter deviates from the actually absorbed amount of NOx, making it difficult to correctly judge the timing for executing the regenerating operation of FIG. 8.

In order to solve the above-mentioned problem in this embodiment, NOx absorbed by the NOx absorbent 18 is all released and is purified by reduction before the engine is warmed up. That is, in this embodiment, the fact that the NOx absorbent is heated up to its activating temperature is detected by a method that will be described later while the engine is being warmed up, the increment of fuel based on the above-mentioned fuel increment correction factor for warming-up FWL and the fuel increment correction factor after engine start FASE, is canceled from a moment at which the activating temperature is reached, and the amount of fuel injection to the engine is calculated according to the following formula, $$TAU=TP\times FNOX$$

where FNOX is a fuel increment factor for regenerating the NOx absorbent, and is set to a value large enough for purifying by reduction the whole amount of NOx released from the NOx absorbent with the holding amount corresponding to the value $CR_0$ of the counter when it heated up to its activating temperature, i.e., set to such a value that the engine air-fuel ratio acquires a rich air-fuel ratio of about 12.

In this embodiment, the fuel is increased by FNOX for regenerating the NOx absorbent until NOx is almost all released from the NOx absorbent. When the amount of NOx absorbed by the NOx absorbent becomes nearly 0, the ordinary fuel increment for warming-up is resumed (fuel increment based on the fuel increment correction factor for warming-up FWL-and fuel increment correction factor after engine start FASE).

Figure 10:
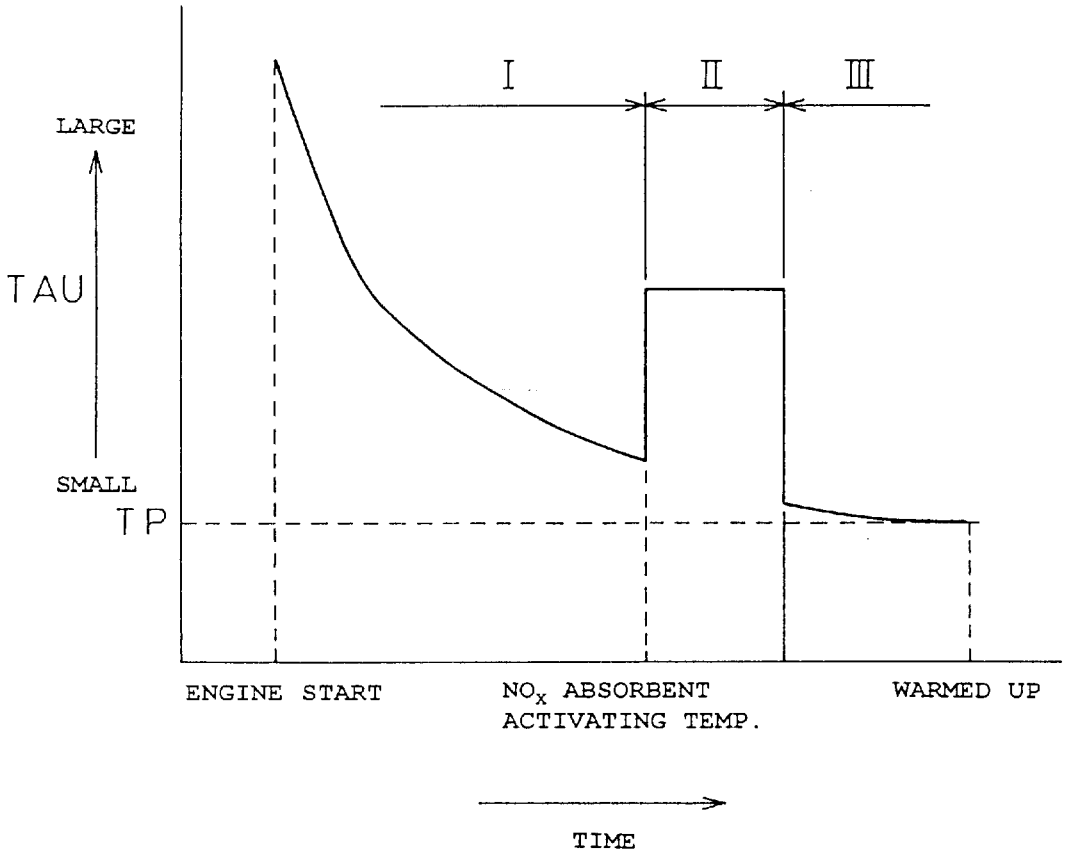
FIG. 10 is a diagram illustrating a change in the fuel increment for the regenerating operation of the NOx absorbent during the warming-up of the engine.

FIG. 10 is a diagram similar to FIG. 9 and illustrates a change in the amount of fuel injection after the cold start of the engine with the passage of time in the above-mentioned case. In this embodiment as shown in FIG. 10, the fuel is increased in the same manner as in FIG. 9 after the start of the engine until the NOx absorbent is heated up to its activating temperature (section I in FIG. 10). When the NOx absorbent is heated up to its activating temperature, however, the amount of fuel injection is increased to a predetermined value (TAU=TP×FNOX) so that the NOx absorbent is regenerated in a sufficiently rich air-fuel ratio atmosphere (section II in FIG. 10). When the NOx is almost all released from the NOx absorbent and is purified by reduction, the fuel is increased again in the same manner as in FIG. 9 (section III in FIG. 10).

Thus, while the engine is being warmed up, the NOx absorbent is regenerated at a rich air-fuel ratio after the NOx absorbent is heated up to its activating temperature, and no unpurified NOx is released from the NOx absorbent while the engine is being warmed up. When the lean air-fuel ratio operation is assumed after the engine has been warmed up, almost no NOx has been absorbed by the NOx absorbent and, hence, the initial value of the NOx holding amount counter CR is set to 0, making it possible to correctly estimate the amount of NOx absorbed by the NOx absorbent during the operation.

Figure 11:
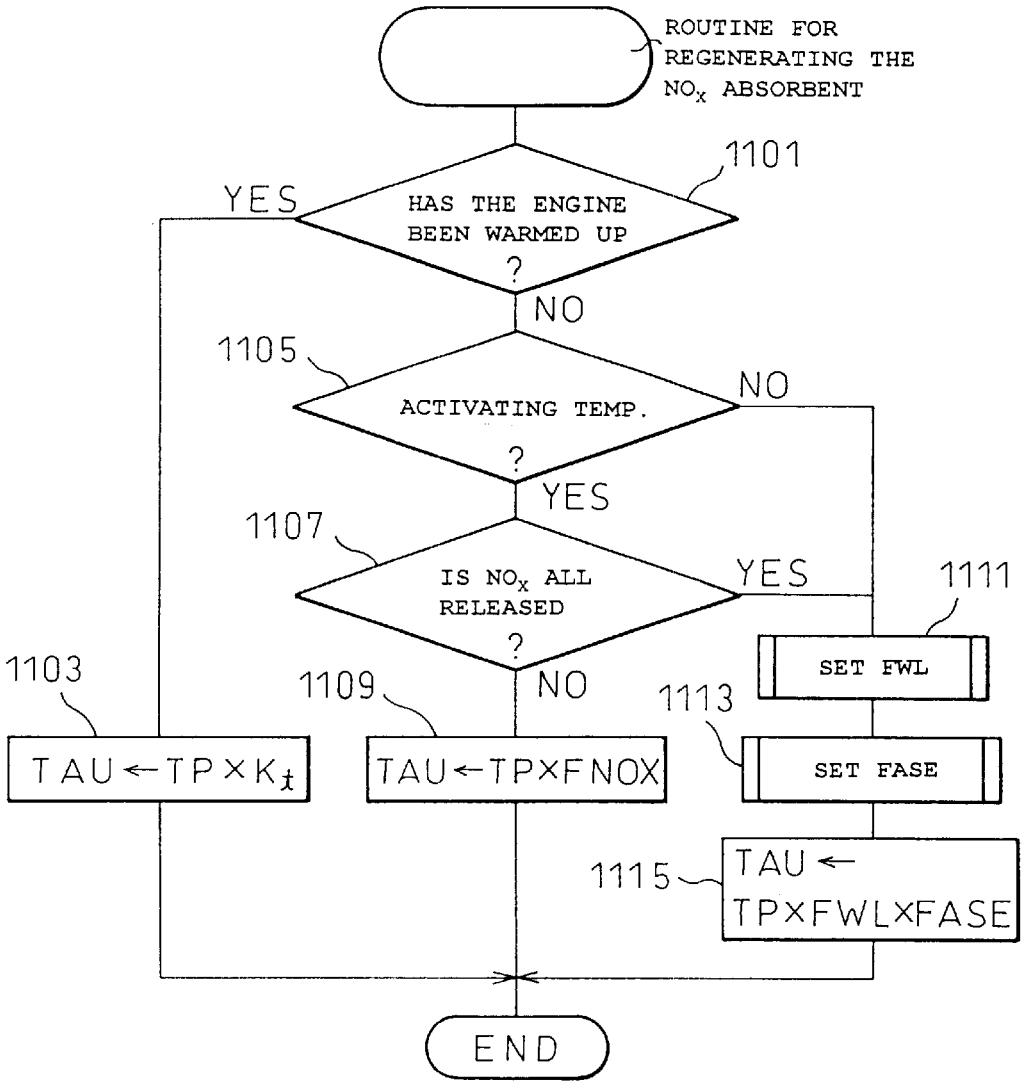
FIG. 11 is a flow chart illustrating the regenerating operation of the NOx absorbent during the warming-up of the engine.

FIG. 11 is a flow chart illustrating the regenerating operation of the NOx absorbent at the start of the engine according to the embodiment. This operation is executed by the control circuit 30 at predetermined intervals.

When the routine starts in FIG. 11, it is judged at step 1101 whether the engine has been warmed up. In this embodiment, whether the engine has been warmed up is judged based upon whether the temperature of the engine cooling water has been raised in excess of a predetermined value (e.g., 80° C.).

When the engine has been warmed up (the temperature of the cooling water is higher than the predetermined value) at step 1101, the routine proceeds to step 1103 where the amount of fuel is set to the value after the engine has been warmed up, and the fuel injection TAU is calculated as TAU=TP×Kt. When the engine has not been warmed up at step 1101, it is judged at step 1105 whether the NOx absorbent 18 has been heated up to its activating temperature. Judgement of whether the temperature of the NOx absorbent has reached the activating temperature at step 1105, will be described later.

When the activating temperature of the NOx absorbent 18 has been reached at step 1105, it is then judged at step 1107 whether NOx has all been released from the NOx absorbent 18. Judgement of whether the releasing of NOx has completed from the NOx absorbent 18 will be described later.

When the NOx absorbent 18 has not yet been heated up to its activating temperature at step 1105 and when the releasing of NOx from the NOx absorbent has not yet been completed at step 1107, the amount of fuel injection TAU at step 1109 is set as TAU=TP×FNOX and the engine is operated at a predetermined sufficiently rich air-fuel ratio, so that NOx is released from the NOx absorbent and is purified by reduction. Thus, NOx released from the NOx absorbent is all purified by reduction, and no unpurified NOx is released into the open air while the engine is being warmed up.

When the activating temperature of the NOx absorbent 18 has not yet been reached at step 1105, and when NOx has almost all been released from the NOx absorbent and has been purified by reduction at step 1107, then, steps 1111 to 1115 are executed, and the fuel injection amount is set as when the engine is being normally warmed up as explained with reference to FIG. 9. That is, at step 1111, the fuel increment correction factor for warming-up FWL is set based on the cooling water temperature and at step 1113, the fuel increment correction factor after engine start FASE is set from an initial value determined by the cooling water temperature and the number of times of fuel injection after the start. At step 1115, further, the fuel injection amount TAU during the warming-up is operated as TAU=TP×FWL×FASE.

Next, described below is a method of judging whether the NOx absorbent has been heated up to its activating temperature, that is executed at step 1105.

Whether the temperature of the NOx absorbent 18 has reached its activating temperature can also be judged by, for example, disposing a temperature sensor on the NOx absorbent 18 to directly detect the temperature of the NOx absorbent. It is further possible to render the judgement based on one of the following methods.

① Judging method based on the cooling water temperature.
② Judging method based on the exhaust gas temperature.
③ Judging method based on the integrated value of the quantity of heat of the exhaust gas passing through the NOx absorbent.
④ Judging method based on the concentrations of particular components in the exhaust gas at the inlet and outlet of the NOx absorbent. These methods will now be described.

① Judging Method Based on the Cooling Water Temperature

The temperature of the NOx absorbent rises with the rise in the temperature of the engine cooling water. Therefore, if the temperature of the engine cooling water (e.g., 70° C.) is actually measured in advance at the time when the Nox absorbent is heated up to its activating temperature (e.g., about 250° C.) after the cold start of the engine, it is possible to judge that the NOx absorbent is activated when the temperature of the engine cooling water has reached the above-mentioned temperature as measured by the cooling water temperature sensor 27 after the start of the engine.

② Judging Method Based on the Exhaust Gas Temperature

In this embodiment, the exhaust gas temperature sensor 26 is installed on the downstream side of the NOx absorbent 18 and detects the temperature of the exhaust gas after it has passed through the NOx absorbent 18. Therefore, the exhaust gas temperature detected by the exhaust gas temperature sensor is nearly equal to the temperature of the NOx absorbent 18 itself. It can, therefore, be judged that the NOx absorbent has reached its activating temperature when the temperature detected by the exhaust gas temperature sensor 26 has reached a predetermined temperature (e.g., activating temperature of the NOx absorbent).

③ Judging Method Based on the Integrated Value of the Quantity of Heat of the Exhaust Gas Passing Through the NOx Absorbent The temperature of the NOx absorbent after the start rises in proportion to the heat given to the NOx absorbent, i.e., in proportion to the integrated value of the quantity of heat of the exhaust gas that has passed through the NOx absorbent after the start. On the other hand, the quantity of heat possessed by the exhaust gas is proportional to, for example, the amount of fuel supplied to the engine or the amount of the air taken in by the engine. Therefore, the amount of fuel injection may be integrated from the start of the engine or the amount of the air taken in by the engine may be integrated from the start of the engine, and when either integrated value has reached a predetermined value, it can be judged that the NOx absorbent has reached its activating temperature. The value for judging the integrated value is set to a value that corresponds to the activating temperature obtained by really measuring the temperature of the NOx absorbent in advance.

④ Judging Method Based on the Concentrations of Particular Components in the Exhaust Gas at the Inlet and Outlet of the NOx Absorbent Whether the temperature of the NOx absorbent has reached its activating temperature, i.e., whether the NOx absorbent is activated, can be judged even based on the concentrations of particular components (HC, CO and NOx components) in the exhaust gas at the inlet and outlet of the NOx absorbent. As explained with reference to FIG. 4, the NOx absorbent, under a rich air-fuel ratio condition, reduces NOx in the exhaust gas flowing in and NOx released from the absorbent upon consuming the HC and CO components in the exhaust gas. When the NOx absorbent has not been activated, however, the HC, CO and NOx components in the exhaust gas flowing in are not reacted in the NOx absorbent but simply pass through the NOx absorbent. In a state where the NOx absorbent has not been activated, therefore, the concentrations of HC, CO and NOx components at the outlet of the NOx absorbent become equal to the concentrations of HC, CO and NOx components at the inlet of the NOx absorbent. As the NOx absorbent is activated, however, the HC and CO components in the exhaust gas flowing in react with the NOx component. Hence, the concentrations of the HC, CO and NOx components at the outlet of the NOx absorbent become lower than the concentrations at the inlet. Therefore, it may be so judged that the NOx absorbent is activated when the ratio of the concentrations of the above-mentioned components at the outlet of the NOx absorbent to the concentration of the above-mentioned components at the inlet has decreased down to a predetermined value (e.g., about 50%). In this embodiment, the exhaust gas component sensors 24 and 25 have been arranged on the upstream side and on the downstream side of the NOx absorbent 18. When the HC sensors are used as the exhaust gas component sensors 24, 25, therefore, the concentrations of HC and CO components in the exhaust gas may be detected and when the NOx sensors are used, the concentration of NOx component may be detected, in order to judge whether the NOx absorbent 18 is activated.

At step 1105 in FIG. 11, any one, or two or more methods among the above-mentioned methods ① to ④ are used in combination to judge whether the temperature of the NOx absorbent has reached its activating temperature.

Next, described below is a method of judging, at step 1107, whether the releasing of NOx from the NOx absorbent is completed.

Whether NOx is almost all released from the NOx absorbent and whether the releasing of NOx is completed, can be judged based, for example, on the following method.

1) Judging Method Based on Whether a Predetermined Period of Time has Passed

In this embodiment as described earlier, a maximum amount of NOx held by the NOx absorbent 18 at the start of the engine is the amount of NOx corresponding to a value $CR_0$ of the NOx holding amount counter. In the practical operation, therefore, NOx can be necessarily released almost all from the NOx absorbent if the regenerating operation of the NOx absorbent is executed for a period of time long enough for releasing NOx of an amount corresponding to the counter value $CR_0$ from the NOx absorbent. Therefore, the time $T_0$ required for releasing the whole amount of NOx from thee NOx absorbent when it held NOx in an amount corresponding to the counter value $CR_0$ is measured in advance and when the regenerating operation is executed at an air-fuel ratio corresponding to the fuel increment factor FNOX, and it is judged that NOx is all released from the NOx absorbent when the passage of time after the start of the regenerating operation has reached the time $T_0$.

2) Judging Method Based on the Oxygen Concentrations in the Exhaust Gas at the Inlet and Outlet of the NOx Absorbent During the regenerating operation of the NOx absorbent, the air-fuel ratio of the exhaust gas flowing into the NOx absorbent is rendered to be rich to a large extent (e.g., air-fuel ratio of about 12) and, hence, the oxygen concentration in the exhaust gas assumes a very small value at the inlet of the NOx absorbent. During the regenerating operation, however, NOx released from the NOx absorbent is reduced with the HC and CO components in the exhaust gas forming $O_2$ on the NOx absorbent. Accordingly, the oxygen concentration in the exhaust gas at the outlet of the NOx absorbent becomes higher than the oxygen concentration in the exhaust gas at the inlet thereof. On the other hand, when NOx is all released from the NOx absorbent, there takes place no reduction reaction of NOx on the NOx absorbent, and $O_2$ is not formed any longer. After NOx is all released from the NOx absorbent, therefore, the oxygen concentration in the exhaust gas at the outlet of the NOx absorbent decreases down to the oxygen concentration at the inlet thereof. During the regenerating operation of the NOx absorbent, therefore, the oxygen concentration in the exhaust gas is monitored at the outlet of the NOx absorbent, and it is judged that the releasing of NOx from the NOx absorbent is completed when the oxygen concentration has decreased down to become equal to the oxygen concentration in the exhaust gas at the inlet of the NOx absorbent. This judging method can be carried out when the oxygen concentration sensors are used as the exhaust gas component sensors 24 and 25.

3) Judging Method Based on the Amount of NOx Absorbed by the NOx Absorbent of when the Engine is Stopped in the Previous Time As described earlier, NOx may be released from the NOx absorbent while the engine is halting, and the amount of NOx is not necessarily in agreement with the amount of NOx held when the engine was stopped in the previous time. However, the amount of NOx held by the NOx absorbent never increases while the engine is halting. If the regenerating operation is executed for a period of time long enough for releasing all NOx held by the NOx absorbent when the engine was stopped in the previous time, therefore, NOx can be reliably released in all amounts from the NOx absorbent. Accordingly, the time for executing the regenerating operation may be set based on the amount of NOx absorbed by the NOx absorbent when the engine was stopped in the previous time, and it may be judged that NOx is all released from the NOx absorbent when the above-noted time has elapsed. In this case, the value of the NOx holding amount counter CR when the engine was stopped in the previous time stored in the back-up RAM 29 in the control circuit 30 is read out at step 1107 in FIG. 11, and the time for executing the regenerating operation is set based on the value CR. The time for executing the regenerating operation may be stored in the ROM 32 of the control circuit 30 by measuring, in advance, the time required for the regenerating operation while varying the amount of NOx (counter value CR) absorbed by the NOx absorbent. In the above-mentioned method 1), a maximum time necessary for releasing NOx from the NOx absorbent was set, and it was judged that the releasing of NOx was completed when the maximum time has elapsed after the start off the regenerating operation. In practice, the amount of NOx absorbed by the NOx absorbent is not always a maximum amount at the start of the engine, and the regenerating operation may be often continued for longer than a required time. According to this judging method, however, the time for executing the regenerating operation is set based on the amount of NOx actually absorbed by the NOx absorbent, and the regenerating operation is not executed for longer than a required time, offering an advantage of suppressing an increase in the fuel consumption.

Next, described below is another embodiment of the present invention.

In the above-mentioned first embodiment, when the amount of NOx absorbed by the NOx absorbent has increased to some extent during the normal operation of the engine (i.e., during the operation at a lean air-fuel ratio), the engine air-fuel ratio was controlled to acquire a rich air-fuel ratio for a predetermined period in order to regenerate the NOx absorbent and, hence, to prevent the NOx absorbent from being saturated with NOx. That is, in the above-mentioned first embodiment, the regenerating operation of the NOx absorbent was executed every time when the amount (CR) of NOx absorbed by the NOx absorbent has reached about 70 to 80% of the maximum Nox holding capacity (saturation amount) of the NOx absorbent as described with reference to FIG. 8. However, when the NOx absorbent is regenerated by rendering the engine air-fuel ratio to be a rich air-fuel ratio during the normal operation (during the operation at a lean air-fuel ratio), the fuel consumption of the engine increases and the output torque of the engine undergoes a change accompanying a change in the air-fuel ratio. In the embodiment described below, therefore, the NOx absorbent having a large maximum NOx holding capacity is used in order to lower the frequency for executing the regenerating operation during the normal operation (a lean air-fuel ratio operation) of the engine (or in order not to execute the regenerating operation during the normal operation) to prevent the fuel consumption from being increased and to prevent a change in the output torque.

First, described below is a means for increasing the maximum NOx holding capacity (saturation amount) of the NOx absorbent.

The following methods can be exemplified for increasing the saturation amount of the NOx absorbent.

① To Increase the Capacity (Volume) of the NOx Absorbent

When the NOx holding amount per a unit volume remains the same, a maximum NOx holding capacity increases in proportion to the volume of the NOx absorbent.

② To Change the Composition of the Absorbent into the One Capable of Holding NOx in Large Amounts In the description related to FIG. 4, barium oxide BaO was used as a NOx absorbing material (hereinafter referred to as "absorbing material") for the NOx absorbent. It has been known that an absorbing material having strong basic property makes it possible to increase the NOx holding capacity per a unit volume of the NOx absorbent. By using an alkali metal having a strong basic property, such as potassium K or cesium Cs instead of barium Ba, therefore, it is allowed to increase the maximum NOx holding capacity of the NOx absorbent while maintaining the volume of the NOx absorbent the same.

③ To Dispose a Three-way Catalyst on the Upstream Side of the NOx Absorbent

The HC component existing in large amounts in the exhaust gas may adhere onto the NOx absorbent to decrease its NOx absorbing capacity. Therefore, the NOx holding capacity of the NOx absorbent can be increased (drop in the holding capacity can be prevented) even by preventing the HC component from arriving in large amounts at the NOx absorbent by disposing the three-way catalyst in the exhaust passage on the upstream side of the NOx absorbent. The three-way catalyst oxidizes NO in the exhaust gas under the condition of a lean air-fuel ratio to form $NO_2$. As described with reference to FIG. 4, on the other hand, NO is once oxidized to $NO_2$ion the NOx absorbent, and $NO_2$ is further oxidized to form nitric acid ions to absorb NOx. Therefore, the three-way catalyst is disposed on the upstream side if the NOx absorbent and NOx is supplied in the form of $NO_2$ to the NOx absorbent, so that the absorption of NOx by the NOx absorbent is promoted.

④ To Adjust the Exhaust Gas Temperature at the Inlet of the NOx Absorbent to Lie Within a Particular Range A maximum NOx amount that can be held by the NOx absorbent varies based on the temperature of the NOx absorbent. In a region where the temperature of the NOx absorbent is low, for example, the maximum NOx holding amount of the NOx absorbent increases with an increase in the temperature. When a given temperature region (maximum holding amount temperature region) is exceeded, however, NOx held in the absorbent in the form of a nitrate is released due to the thermal decomposition, and the maximum NOx holding capacity decreases. Therefore, the maximum NOx holding capacity of the NOx absorbent can be increased even by disposing the NOx absorbent in the exhaust passage where the temperature of the exhaust gas flowing into the NOx absorbent lies in the maximum holding amount temperature region during the normal operation of the engine. It is also possible to install cooling fins or a jacket for cooling water in the exhaust passage in order to positively adjust the temperature of the NOx absorbent.

In a second embodiment and a third embodiment described below, any one method or two or more methods among the above-mentioned methods are employed to use the NOx absorbent having an increased maximum NOx holding capacity. In the following embodiments, the constitution of the whole device is the same as that of FIG. 1.

(2) Second Embodiment

In this embodiment, the regenerating operation (FIG. 8) based on the amount of NOx absorbed by the NOx absorbent is not executed the regenerating operation of FIG. 11 is executed when the engine is started in order to release almost all NOx absorbed by the NOx absorbent and to purify it by reduction. Under the operating condition where a high engine output is required such as during the acceleration operation or the high-load operation of the engine, however, the engine is operated at a rich air-fuel ratio, the exhaust gas of a rich air-fuel ratio is supplied to the NOx absorbent in order to regenerate the NOx absorbent.

Figure 2:
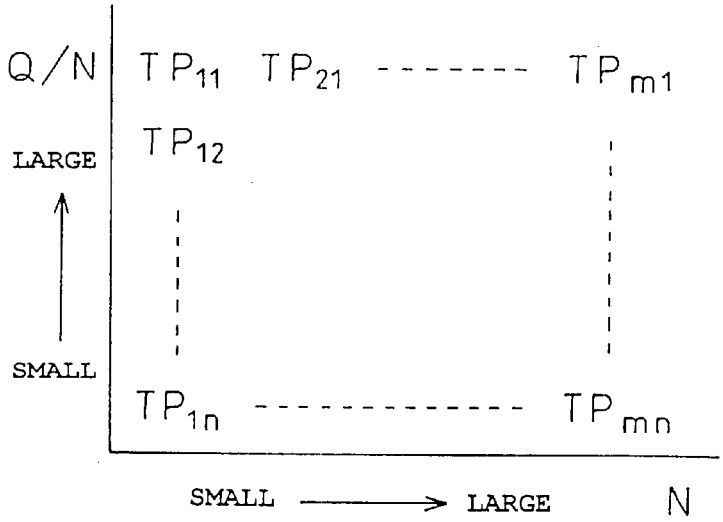
FIG. 2 is a diagram illustrating the form of a map used for calculation the amount of fuel injection for the engine of FIG. 1.
Figure 12:
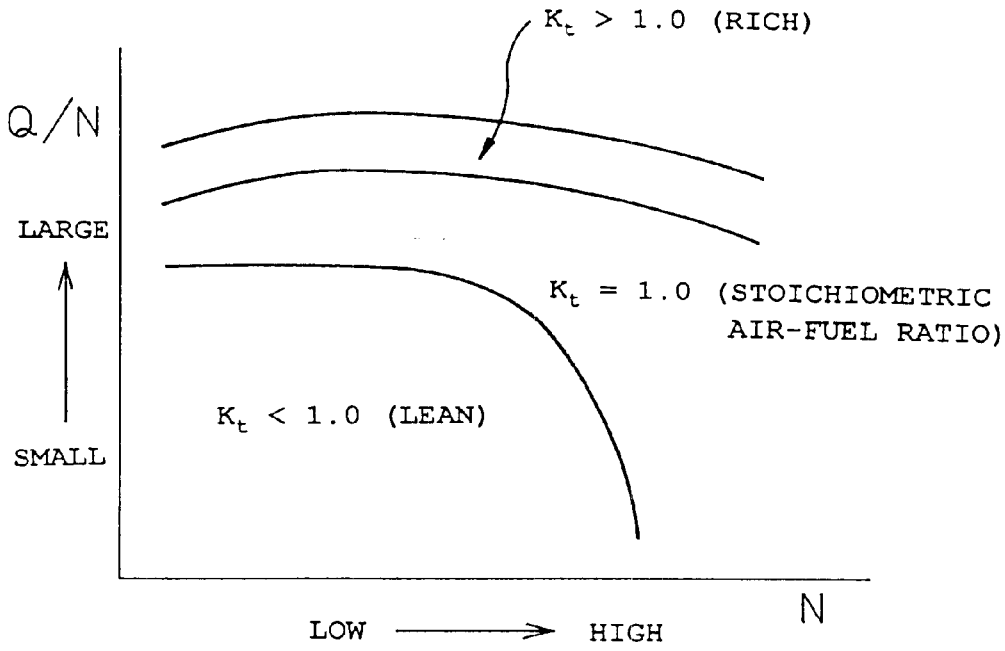
FIG. 12 is a chart for setting a correction factor for the amount of fuel injection based on the operating conditions of the engine.

In this embodiment, too, the fuel infection amount correction factor Kt of the engine 1 is set based on the engine intake air amount Q and the rotational speed N based on the map of FIG. 2. In the operation region where an engine output is required such as during the acceleration operation or the high-load operation of the engine, however, the value Kt is set to be $Kt \geqq 1.0$ (stoichiometric air-fuel ratio or rich air-fuel ratio) in this embodiment. FIG. 12 is a graph illustrating how to set the value Kt in this embodiment. As shown in FIG. 12, the value Kt is set to $Kt > 1.0$ (rich) in a region where the load (Q/N) is large to maintain the engine output.

In this embodiment, therefore, when the engine is operated at a rich air-fuel ratio during the acceleration operation or the high-load operation, the exhaust gas of a rich air-fuel ratio flows into the NOx absorbent, and the absorbed NOx is released from the NOx absorbent and is purified by reduction.

In this embodiment, as described above, the regenerating operation of the NOx absorbent is executed only when the engine is under a particular operating condition. Therefore, the frequency for executing the regenerating operation of the NOx absorbent greatly varies in accordance with the engine operating conditions. In this embodiment as described above, a maximum NOx holding capacity of the NOx absorbent is set to be larger than that of the first embodiment, and the NOx absorbent is not saturated even when the operation at a very rich air-fuel ratio is executed less frequently. Upon setting the maximum NOx holding capacity of the NOx absorbent to be large, as described above, the engine is operated at a rich air-fuel ratio only when the driver requests a high engine output. The operation at a rich air-fuel ratio which is not expected by the driver, does not take place (i.e., there does not take place an operation at a rich air-fuel ratio that was executed in the first embodiment relying on the amount of NOx absorbed by the NOx absorbent). This prevents the occurrence of a change in the engine output that is not expected by the driver, and the drivability of the vehicle is not worsened.

In this embodiment, the value Kt during the acceleration operation or the high-load operation of the engine is set to the side slightly more rich than a value determined from the request for the engine output (e.g., set to an air-fuel ratio of about 12). Therefore, the NOx absorbent is regenerated to a sufficient degree even during the acceleration operation or the high-load operation of the engine for a relatively short period of time. In this embodiment, further, if the maximum NOx holding capacity of the NOx absorbent is set to a sufficiently large value, the NOx absorbent is not saturated during the operation even if the NOx is not released in whole amounts from the NOx absorbent during the rich air-fuel ratio operation such as during the acceleration operation or during the high-load operation of the engine. It is therefore possible to set the value Kt during the acceleration operation or the high-load operation of the engine to a relatively small value determined from the request for the engine output, so that the absorbed NOX is only partly released. In this case, the NOx absorbent is regenerated in an additional manner during the acceleration operation or the high-load operation of the engine in contrast with the regenerating operation for the NOx absorbent at the start of the engine.

(3) Third Embodiment

In this embodiment, too, the operation of FIG. 11 is executed at the start of the engine to release almost all of the absorbed NOx from the NOx absorbent. In this embodiment, however, the operation at a rich air-fuel ratio is not executed even during the acceleration operation or the high-load operation of the engine, and the fuel injection amount correction factor Kt is set to be $Kt \leqq 1.0$ in all operating region. That is, the NOx absorbent is regenerated at the start of the engine only and is not regenerated during the normal operation. In this embodiment, the maximum NOx holding capacity of the NOx absorbent is set to be greater than that of the second embodiment so as to absorb and holed the whole amount of NOx emitted during the operation of the engine. Accordingly, the regenerating operation of FIG. 8 is not executed during the normal operation of the engine (during the operation at a lean air-fuel ratio). This prevents a change in the engine output caused by a change in the air-fuel ratio and completely suppresses an increase in the fuel consumption.

In the second and third embodiments, too, the amount CR of NOx absorbed by the NOx absorbent may be estimated through the operation of FIG. 7 and the value CR may be stored in the back-up RAM, in order to change the time for executing the rich air-fuel ratio operation at the start of the engine relying on the absorbed amount of NOx of when the engine was stopped in the previous time.

According to the present invention as described above, it is allowed to prevent unpurified NOx being released from the NOx absorbent at the start of the engine, and the exhaust gas can be efficiently purified by utilizing the NOx absorbing ability (absorbing capacity) of the NOx absorbent to the maximum degree. When the nox absorbent having a large nox absorbing capacity is used, therefore, the exhaust gas can be purified to a sufficient degree even without executing the operation at a rich air-fuel ratio for regenerating the nox absorbent during the operation of the engine.

What is claimed is:

1. An exhaust gas purification device for an internal combustion engine, comprising:

a NOx absorbent disposed in an exhaust passage of the internal combustion engine, said NOx absorbent absorbs NOx in the exhaust gas when the air-fuel ratio of the exhaust gas flowing in is lean, and releases the absorbed Nox and purifies it by reduction in a rich air-fuel ratio atmosphere; and a NOx-releasing means which, after the start of the engine, operates the engine at a predetermined rich air-fuel ratio by increasing the amount of fuel supplied to the engine, so that NOx absorbed by said NOx absorbent is released and is purified by reduction until the engine is first operated at a lean air-fuel ratio after the engine is started.

2. An exhaust gas purification device for an internal combustion engine according to claim 1, wherein said NOx releasing means increases the amount of fuel supply after said NOx absorbent is heated up to its activating temperature.

3. An exhaust gas purification device for an internal combustion engine according to claim 1, wherein said NOx releasing means includes a means for estimating and storing the amount of NOx absorbed by said NOx absorbent when the engine was last stopped, and a varying means for varying the period in which the fuel is supplied in an increased amount to the engine based on the absorbed amount of NOx that is estimated and stored.

4. An exhaust gas purification device for an internal combustion engine according to claim 3, wherein said NOx releasing means increases the amount of fuel supply after said NOx absorbent is heated up to its activating temperature.

5. An exhaust gas purification device for an internal combustion engine according to claim 1, further comprising a regenerating means which, when predetermined conditions are established while the engine is in operation at a lean air-fuel ratio, executes the regenerating operation by exposing said NOx absorbent to a rich air-fuel ratio atmosphere, so that the absorbed NOx is released from said NOx absorbent and is purified by reduction.

6. An exhaust gas purification device for an internal combustion engine according to claim 5, wherein said regenerating means executes the regenerating operation during the acceleration operation or the high-load operation of the engine.

7. An exhaust gas purification devise for an internal combustion engine according to claim 6, wherein said NOx releasing means increases the amount of fuel supply after said NOx absorbent is heated up to its activating temperature.

8. An exhaust gas purification device for an internal combustion engine according to claim 5, wherein said regenerating means includes an estimation means for estimating the amount of NOx absorbed by said NOx absorbent during the operation of the engine, and executes the regenerating operation when the estimated amount of NOx absorbed by said NOx absorbent has reached a predetermined value during the operation of the engine at a lean air-fuel ratio.

9. An exhaust gas purification device for an internal combustion engine according to claim 8, wherein said NOx releasing means includes a varying means for varying the period in which the fuel is supplied in an increased amount to the engine based on the absorbed amount of NOx when the engine was last stopped, that is estimated by said estimating means.

10. An exhaust gas purification device for an internal combustion engine according to claim 9, wherein said NOx releasing means increases the amount of fuel supply after said NOx absorbent is heated up to its activating temperature.

11. An exhaust gas purification device for an internal combustion engine according to claim 8, wherein said NOx releasing means increases the amount of fuel supply after said NOx absorbent is heated up to its activating temperature.

12. An exhaust gas purification device for an internal combustion engine according to claim 5, wherein said NOx releasing means increases the amount of fuel supply after said NOx absorbent is heated up to its activating temperature.

13. An exhaust gas purification device for an internal combustion engine according to claim 12, wherein said NOx releasing means includes a means for estimating and storing the amount of NOx absorbed by said NOx absorbent when the engine was last stopped, and a varying means for varying the period in which the fuel is supplied in an increased amount to the engine based on the absorbed amount of NOx that is estimated and stored.

* * * * *

UNITED STATES PATENT AND TRADEMARK OFFICE

CERTIFICATE OF CORRECTION

PATENT NO. : 6,477,834 B1
DATED : November 12, 2002
INVENTOR(S) : Takamitsu Asanuma et al.

It is certified that error appears in the above-identified patent and that said Letters Patent is hereby corrected as shown below:

Title page, Item [54] and Column 1, lines 1-3,
Change the title to read:
-- EXHAUST GAS PURIFICATION DEVICE FOR AN INTERNAL COMBUSTION ENGINE --

Column 2,
Line 42, change "NOX" to -- $NO_x$ --.

Column 4,
Line 18, change "NOX" to -- $NO_x$ --.

Column 6,
Line 6, change "exhaust,, gas" to -- exhaust gas --.
Line 55, change "concentrations" to -- concentration --.

Column 8,
Line 20, change "NOX" to -- $NO_x$ --.
Line 29, change "ares" to -- are --.

Column 10,
Line 7, change "thee" to -- the --.
Line 22, change "conditions" to -- condition --.

Column 16,
Line 6, change "Nox" to -- $NO_x$ --.
Line 58, change "$NO_2$ion" to -- $NO_2$ on --.

Column 18,
Line 40, change "holed" to -- hold --.
Line 63, change "nox" to -- $NO_x$ --.

UNITED STATES PATENT AND TRADEMARK OFFICE

CERTIFICATE OF CORRECTION

PATENT NO. : 6,477,834 B1
DATED : November 12, 2002
INVENTOR(S) : Takamitsu Asanuma et al.

It is certified that error appears in the above-identified patent and that said Letters Patent is hereby corrected as shown below:

Column 19,
Line 5, change "$N_{ox}$" to -- $NO_x$ --.
Line 45, change "devise" to -- device --.

Signed and Sealed this

Twentieth Day of April, 2004

JON W. DUDAS
*Acting Director of the United States Patent and Trademark Office*